United States Patent [19]

Nutt et al.

[11] 4,128,736

[45] Dec. 5, 1978

[54] CABLE DESIGN WITH LIMITED COLOR CODING

[75] Inventors: Wendell G. Nutt, Dunwoody; Mark E. Roach, Duluth, both of Ga.

[73] Assignee: Bell Telephone Laboratories, Incorporated, Murray Hill, N.J.

[21] Appl. No.: 782,722

[22] Filed: Mar. 30, 1977

[51] Int. Cl.[2] ..... H01B 7/36

[52] U.S. Cl. ..... 174/112; 40/316

[58] Field of Search ..... 174/112; 40/316

[56] References Cited

U.S. PATENT DOCUMENTS

| | | | |
|---|---|---|---|
| 218,848 | 6/1943 | Beckett | 174/112 |
| 1,727,955 | 9/1929 | Biggar | 174/112 |
| 1,727,972 | 9/1929 | Ford | 174/112 |
| 1,856,676 | 5/1932 | Weston | 174/112 |
| 3,020,335 | 2/1962 | Gillis | 174/112 |
| 3,031,524 | 4/1962 | Hicks | 174/112 |

FOREIGN PATENT DOCUMENTS

| | | | |
|---|---|---|---|
| 135754 of | 1854 | United Kingdom | 174/112 |

OTHER PUBLICATIONS

Magazine Article from "Bell Laboratories Record", entitled "LOCAP", pp. 220–221, co-authored by the applicant.

*Primary Examiner*—J. V. Truhe
*Assistant Examiner*—John H. Bouchard
*Attorney, Agent, or Firm*—Sylvia J. Chin

[57] ABSTRACT

While randomized splicing of twisted conductor pairs within groups in pulp cables is generally desirable to avoid electrical degradation resulting from systematic additions of capacitance unbalances, restoration of such cables, when severed, requires identification of each conductor pair for splicing. A cable design with a restoration color code has been developed which features groups having a manageable number of conductor pairs for identification splicing. Each group comprises several conductor pairs which have unique color combinations and which are precisely arranged in the group so the remaining conductor pairs having repeating color combinations can be identified by position relative to the uniquely colored pairs.

12 Claims, 9 Drawing Figures

CABLE DESIGN WITH LIMITED COLOR CODING

FIELD OF THE INVENTION

This invention relates to telecommunications cables and more particularly to an improved cable design having a limited color code for identifying conductor pairs.

BACKGROUND OF THE INVENTION

Random splicing of conductor pairs within groups in cables, especially those having pulp-insulated conductors, is generally desirable to avoid electrical degradation resulting from systematic addition of capacitance unbalances in the transmission lines. However, where a pulp cable has been installed and then accidentally cut, restoration of the cable requires matching up of the cut conductor pairs for splicing. Such a chore is unduly burdensome as pulp cables are typically grouped into large groups of 100 or 50 unidentified pairs and requires that repairmen identify each conductor pair by verification and identification testing.

Complete color coding of such cables is not generally desirable since pair identification is not often needed and to maintain pair identity by always splicing according to a color code would substantially increase splicing cost. Also, the manufacturing cost can increase substantially, especially when setting up an inventory of conductors of many colors. Also, the more colors there are, the more mistakes a workman can make during splicing, as the identifying colors approach each other in shade. Furthermore, unlike polyethylene insulation, pulp insulation does not offer a wide variety of distinguishable colors.

Hence, it is desirable to develop a scheme which permits unique identification of the conductor pairs by visual examination when a cable needs to be restored at a minimum of added manufacture cost and at a reduced reliance on color.

Accordingly, it is one object of this invention to develop an improved cable design which facilitates identification of all conductor pairs in the cable by visual examination.

It is another object of this invention that the cable design be of minimum added cost to manufacture.

A further object of this invention is that the improved cable design be more compatible with modular connectors that are increasingly implemented in the field.

SUMMARY OF THE INVENTION

The foregoing objects and others are achieved by arranging a plurality of conductor pairs in a cable structure into a plurality of small groups, where each group comprises a relatively small number of conductor pairs with several of the conductor pairs in the group having unique color combinations and being precisely arranged, so that determination of the remaining conductor pairs, which have repeating color combinations, can be made by examining their position relative to the uniquely colored and arranged conductor pairs.

The invention and its further objects, features, and advantages will be more readily discerned from a reading of the description to follow of illustrative embodiments.

DETAILED DESCRIPTION OF ILLUSTRATIVE EMBODIMENTS

Figure 1:
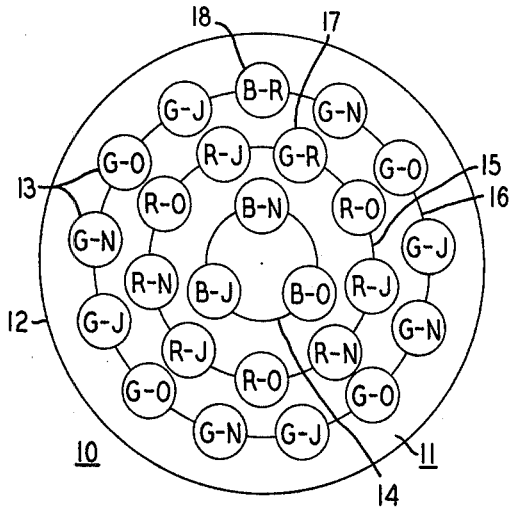
FIG. 1 depicts one illustrative embodiment of a cable comprising the basic group featuring the inventive arrangement of conductor pairs made in accordance with this invention.
Figure 2:
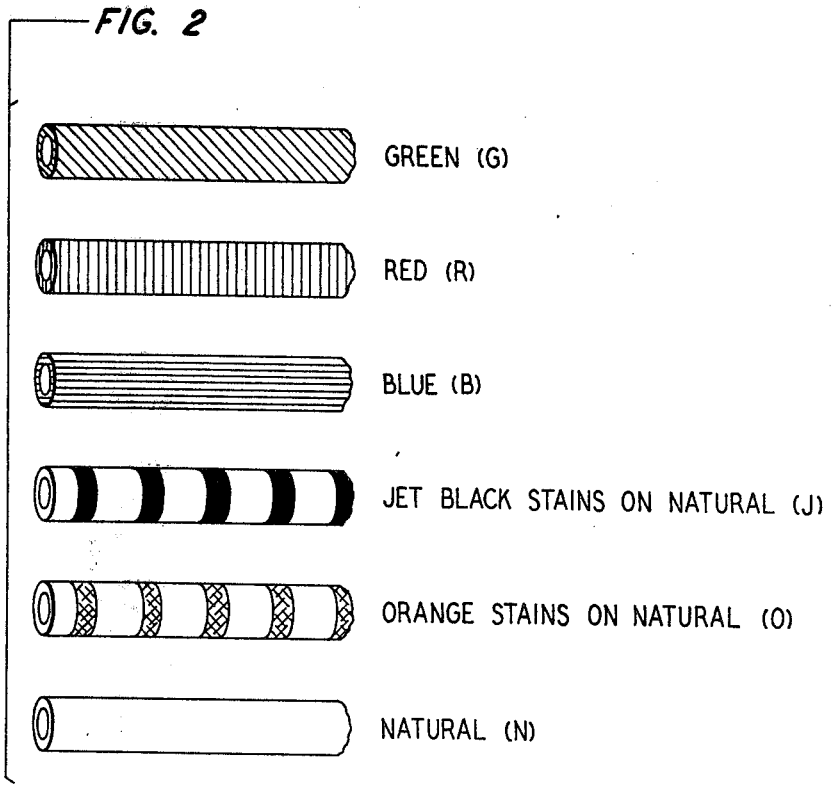
FIG. 2 depicts the colors given the conductors in FIG. 1.

Depicted in FIG. 1 is a cable 10 having a group 11 held together by a retaining means 12, such as a binder, and comprised of twisted pairs of conductors 13 arranged and color coded in a manner which facilitates identification of each conductor pair by visual examination. This illustrative group 11, which comprises 25 conductor pairs, is advantageously compatible for connection with many modular connectors in the market. In the illustrative embodiment, the conductors 13 are insulated with pulp material. Each conductor in the group is given some type of color identification. Some of the conductors are stained a solid color, i.e., red (R), green (G), or blue (B), while other conductors are left with the natural pulp (N) as the identifying color or else are natural pulp with band markings of jet black (J) or orange (O) stains periodically along the length of the conductors. Only six colors are used; the colors of the conductors are schematically shown in FIG. 2.

The solidly colored conductors (B, R, G) are generally utilized as the ring side of the conductor pairs, while the conductors having the naturally colored pulp (N) with or without additional stains (J and O) are generally utilized as the tip side of the conductor pairs.

The pairs are combined to form the various color combinations: G-J, G-N, G-O, R-J, R-N, R-O, B-J, B-N, B-O, G-R, and B-R. Of the 11 color combinations made above, it is noted that the last two color combinations are two solid colored pairs (B-R and G-R).

In FIG. 1, the designations, for example G-O, indicate first the color of the ring side of a conductor pair 13 (green here) and then the color of the tip side of the same conductor pair 13 (orange stains on natural pulp).

The conductor pairs are assembled in layers in group 11, with a center layer 14 having three conductor pairs, a middle layer 15 having nine conductor pairs, and an outer layer 16 having thirteen conductor pairs.

To ensure good crosstalk performance of the conductor pairs 13 in group 11, the pairs 13 are given different twists and spatially arranged in group 11 pursuant to a twist plan. The pairs 13 in the illustrative group 11 are advantageously twisted according to a plan using a constant twist frequency spacing spectrum. The pairs 13 that are in close physical proximity are well separated in twist characteristics. Also, the layers of group 11 are oscillated with respect to each other during the stranding operation of group 11 to further ensure that the assigned pair positions and separations are maintained. The particular twist plan used and the oscillated layering technique are disclosed in a copending application, Ser. No. 637,066, filed Dec. 2, 1975, which is also assigned to the assignee hereof. The copending application to the extent relevant is hereby incorporated by reference.

Pursuant to this invention, the center layer 14 comprises three conductor pairs having unique color combinations in the group, i.e., B-N, B-J, B-O, while the middle layer 15 and outer layer 16 each has one marker pair, 17 and 18, respectively with preselected and unique color combinations in the group. Pairs 17 and 18, have a G-R and B-R color combination respectively. These color combinations advantageously facilitate easy visual detection of the marker pairs, 17 and 18 because both conductors in the pairs are solidly colored and stand out, unlike the remaining conductor pairs in layers 15 and 16 which appear with tip conductors having a natural pulp (N) color with or without orange (O) or jet black (J) stains.

In the middle layer 15 the remaining conductor pairs, other than pair 17 have repeating color combinations. Starting from marker pair 17, in a clockwise direction, the first, second and third pairs have the combinations R-O, R-J, and R-N respectively; the same sequence continues around the layer 15.

Similarly, in outer layer 16 the conductor pairs, other than marker pair 18, also have repeating color combinations. Starting from marker pair 18 and going clockwise, the first, second and third pairs have the color combinations G-N, G-O and G-J respectively; the same sequence continues around the layer.

Another feature of this arrangement is that a pair having a particular color combination is arranged adjacent only to pairs having color combinations different from the former whether they are in the same layer or in adjacent layers. Hence, pairs with identical color combinations are well separated physically.

In the illustrative group 11, each conductor pair can be visually identified for splicing when a cut cable needs to be restored. The three conductor pairs in the center layer 11 are identifiable solely by color as are the marker pairs 17 and 18. The remaining conductor pairs in the middle and outer layers 15 and 16 are identifiable by examining their position with respect to the marker pairs in their layer.

It is further noted that in any layer, the pairs with repeating color combinations all comprise ring conductors of the same color. For example, all the repeating color combination pairs in middle layer 15 have red (R) ring conductors, while the repeating color combination pairs in outer layer 16 have green (G) ring conductors. Since the tip conductors of these pairs are of natural pulp cross sectionally, in an examination of group 11, the solid colors red and green of the ring conductors will aid to indicate the layers 15 and 16, respectively.

Advantageously, the conductor pairs flanking the marker pairs 17 and 18 in layers 15 and 16 respectively have different color combinations. Hence, for example, in layer 16 there is only one conductor pair having a G-N color combination adjacent to marker pair 18 when examining the left and right flanking conductor pairs 13 with respect to marker pair 18.

Figure 3:
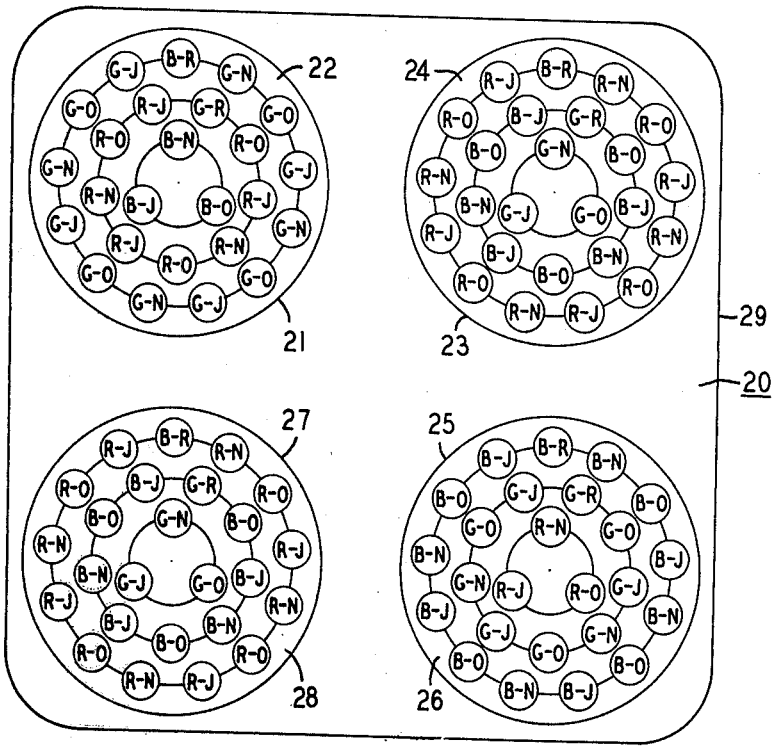
FIGS. 3 and 4 illustrate how a plurality of the groups depicted in FIG. 1 are built up to form one illustrative cable embodiment.
Figure 4:
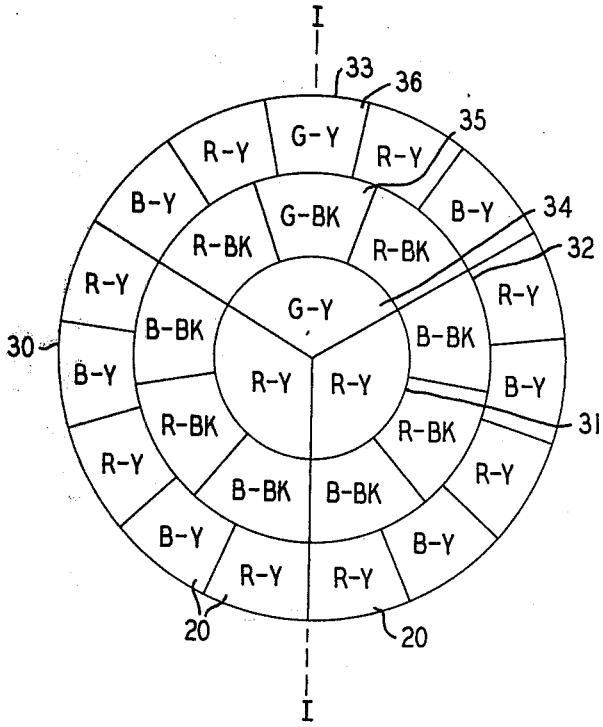

FIGS. 3 and 4 show an illustrative multiunit pulp cable built up from the basic group 11. FIG. 3 depicts a hundred pair unit 20 made up of four groups or subunits 22, 24, 26, and 28. Group 22's color arrangement of the conductor pairs is identical to group 11 in FIG. 1. Groups 24, 26, and 28 illustrate other possible color arrangements of the conductor pairs in a group. Each group is held together with a different colored binder to permit its identification in unit 20. As illustrated in FIG. 3, each group 22, 24, 26, 28, is held together with a plastic binder of blue (B) 21, orange (O) 23, green (G) 25, and brown (BR) 27 respectively. The four bindered groups are then held together as unit 20 with additional binders 29 that are described below.

The FIG. 4 drawing represents a 2700 pair cable with the cable core 30 built up from 27 bindered unit 20. The cable core 30 comprises a center layer 31 of three units, a middle layer 32 of nine units, and another layer 33 of 15 units. Each unit 20 is held together by two binders. One binder, i.e., red (R), green (G), or blue (B), is used to identify a unit's position within a layer, while a second binder, i.e., yellow (Y) or black (BK), is used to define the unit layer. Referring to FIG. 4, only one unit 20 in each layer is held together with a green binder. The green bindered unit establishes the starting point for identifying a unit's position within a layer, the remaining units in the layer then alternate between units with red (R) and blue (B) binders going away from the green bindered unit from either side with the green bindered unit being flanked by units with red binders. Hence, green bindered units 34, 35 and 36 operate as the marker units for layers 31, 32, and 33 respectively. Identification of a unit in a layer is done by examination of its color binders and the unit's position with respect to the green bindered unit in that layer.

The second binder alternates between yellow and black with the center layer 31 units being held together with yellow binders, the middle layer 32 units being held together with black binders, and the outer layer 33 units being held together with yellow binders. The notations in FIG. 4 within each unit 20 indicate the colors of the first and second binders. For example, R-Y signifies that a unit 20 is wrapped with a red binder and a yellow binder.

A close look at FIG. 4 will readily reveal that either end of any portion of the cable core 30 can be readily spliced to either end of another cable portion because the cable is symmetrical about the green bindered units. An imaginary line I—I drawn down the middle of the cable core 30 splitting the green bindered units in half illustrates that one-half of the cable arrangement forms a mirror image of the other.

Figure 5:
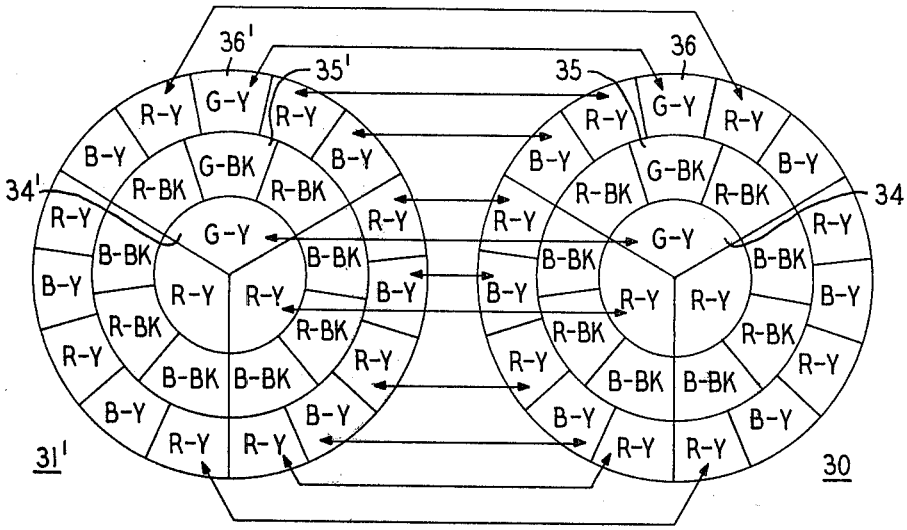
FIGS. 5 and 6 depict how the FIG. 4 cable is spliced to another cable.
Figure 6:
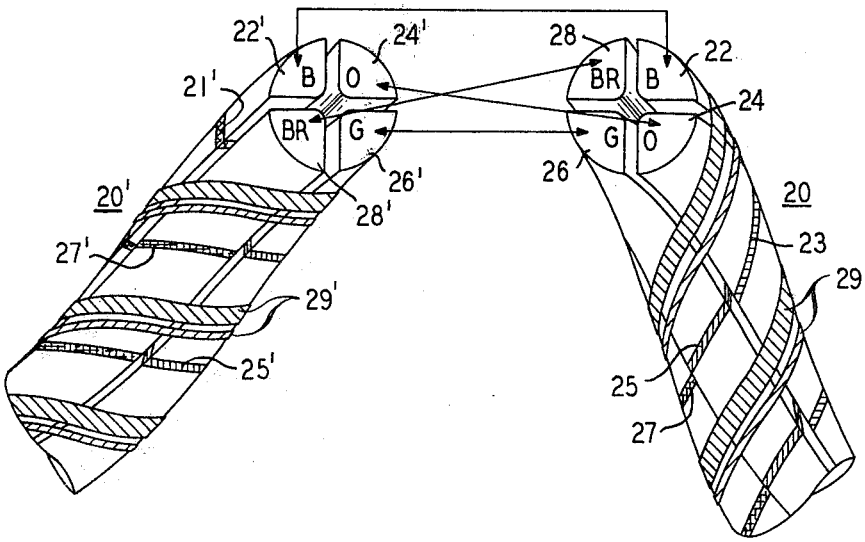

During regular installation splicing of one cable to another, it is generally desirable to maintain the integrity of the units 20 and the subunits or groups 22, 24, 26, and 28 within the cables by splicing to identical colored groups and units as depicted in FIGS. 5 and 6. However, within the groups 22, 24, 26, and 28 random splicing is made of the conductor pairs to reduce the time required to splice and to avoid electrical degradations that result from systematic additions of capacitance unbalances.

When an installed cable has been severed, the units 20 and groups 22, 24, 26, and 28 are matched up for restoration as for regular splicing. However, in restoring the cable, the conductor pairs within each group of one severed cable half must be identified and spliced to their corresponding pairs in the corresponding group of the other severed cable half at which time the limited color arrangement in each group is used.

Figure 7:
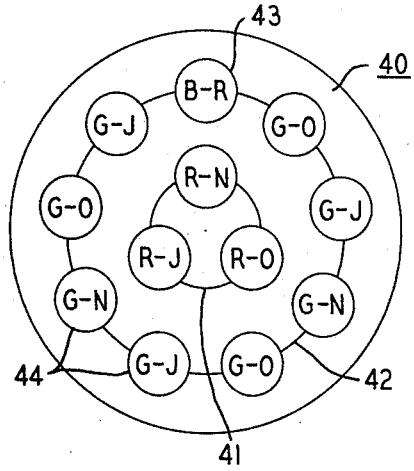
FIGS. 7 and 8 depict two alternative groups also featuring the inventive arrangement.
Figure 8:
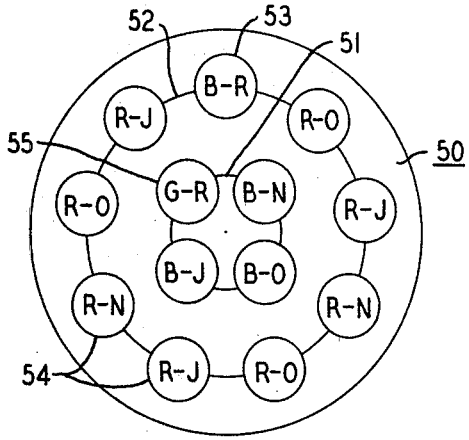
Figure 9:
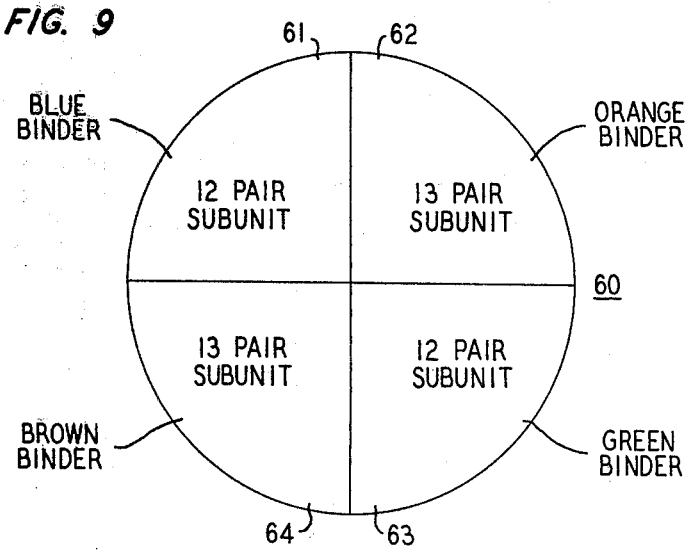
FIG. 9 illustrates the use of the FIGS. 4 and 5 groups to build up a unit for an alternative multiunit cable.

FIGS. 7 and 8 depict alternative group or subunit arrangements 40 and 50 having twelve and thirteen conductor pairs respectively. The combination of two 13 pair groups and two 12 pair groups can advantageously build up to a 50 pair unit 60 as depicted in FIG. 9. The 50 pair unit 60, in turn, can be used to build up a cable core similar to that illustrated in FIG. 4. In both groups 40 and 50, the conductor pairs are arranged in a center layer, 41 and 51 respectively, and an outer layer, 42 and 52 respectively.

In the FIG. 7 group 40, the center layer 41 comprises three conductor pairs having unique color combinations (R-N, R-J, R-O) in the group. The outer layer 42, which has nine conductor pairs, comprises a marker pair 43 having the unique color combination of B-R while the remaining conductor pairs 44 have one of the repeating color combinations of G-O, G-J, G-N.

The FIG. 8 group 50 differs from group 40 in that the center layer 51 comprises four conductor pairs having unique color combinations in the group, i.e., G-R, B-N, B-O, B-J; the pair 55 with colors G-R operates as a marker pair to distinguish a 13 pair group from a 12 pair group. The outer layer 52 comprises a marker pair 53 of B-R and a plurality of pairs 54 having repeating color combinations.

As with the FIG. 1 arrangement, the solid-colored conductor pairs with the color combination B-R in FIGS. 7 and 8, 43 and 53, stand out and are used as marker pairs from which to identify the conductor pairs which have repeating color combinations in the outer layers 42 and 53, respectively. Also, no one conductor pair having a particular color combination is stranded adjacent to another pair having an identical color combination in the same or a different layer. Furthermore, the color of the ring side of the conductor pairs in any one layer is identical but for the marker pairs. As with FIG. 1, the notation within each conductor pair in FIGS. 7 and 8 first signifies the ring side of the pair and then the tip side.

In the FIG. 9 unit 60, each group 61, 62, 63, and 64 is held together with a binder of a different color. However, it is realized at times that a 25 pair grouping might be desirable. Hence, in such a situation, groups 61 and 62 might each be wrapped with plastic binders having the same color, say blue, while the groups 63 and 64 are wrapped with binders of a different color, say orange, to form sets of 25 identifiable pairs. The groups 61 and 62 are readily distinguishable between each because of their order in the unit 60. A further aid is that two solid-colored marker pairs are in group 62, which is a 13 pair subunit, while only one marker pair is in group 61, which is a 12 pair subunit.

While the invention has been described with reference to specific embodiments, it is to be understood that various modifications thereto might be made without departing from the spirit and scope of the following claims.

What is claimed is:

1. A telecommunications cable comprising:

a plurality of insulated conductors where each conductor has some color identification on its insulation and where said conductors are twisted into conductor pairs, each pair having a first and second conductor with said conductors within each said pair being visibly distinguishable from each other by color;

said conductors being assembled into at least one group having a center layer of nonmarker pairs and at least one layer of pairs surrounding said center layer, where each said surrounding layer comprises at least one marker pair having a unique color combination in said group, and other nonmarker conductor pairs having repeating color combinations in said group and being arranged with respect to said marker pair so that each repeating color combination pair can be uniquely identified by its position with respect to said marker pair;

and where at least said nonmarker pairs or said center layer pairs and said repeating color combination pairs comprise first conductors having a commonality in visible color characteristics identifying them as first conductors and not second conductors, and second conductors having a commonality in visible color characteristics identifying them as second conductors and not first conductors, to thereby render said cable substantially amendable to routine random splicing of pairs with quick and ready visual identification of first and second conductors.

2. A multipair multiunit telecommunications cable comprising a cable core comprising:

a plurality of units arranged in layers in said core, each unit being identifiable by cable layer and the unit's position in said cable layer;

each said unit comprising a plurality of subunits with each subunit being uniquely identifiable in said unit;

each said subunit comprising a plurality of insulated conductors, where each said conductor has some color identification on its insulation, and where said conductors are twisted in pairs to form various color combinations, each pair comprising first and second conductors with said conductors within each said pair being visibly distinguishable from each other by color;

each said subunit comprising a center layer of pairs and at least one layer of pairs surrounding said center layer, where each said surrounding layer comprises at least one marker pair having a unique color combination in said subunit, and other pairs having repeating color combinations and being arranged with respect to said marker pair so that each repeating color combination pair can be uniquely identified by its position with respect to said marker pair;

and where at least said center layer pairs and said repeating color combination pairs comprise first conductors having a commonality in visible color characteristics identifying them as first conductors and not second conductors, and second conductors having a commonality in visible color characteristics identifying them as second conductors and not first conductors, to thereby render said cable substantially amendable to routine random splicing of pairs with quick and ready visual identification of first and second conductors.

3. The cable pursuant to claim 1 where each conductor pair having a repeating color combination is arranged adjacent only to pairs having different color combinations.

4. The cable pursuant to claim 1 where said center layer pairs and conductor pairs having repeating color combinations each comprises a first conductor with a solidly color-stained insulation and a second conductor with natural colored insulation, said second conductors being distinguishable from other second conductors by different stained color identifying marks or lack thereof occurring periodically on said insulation.

5. The cable pursuant to claim 1 where within each layer said nonmarker pairs have first conductors with identical visible characteristics and where the nonmarker pair first conductors in any layer are visibly distinguishable from the nonmarker pair first conductors in the adjacent layers.

6. The cable pursuant to claim 5 where said nonmarker pair first; conductors are solidly colored red, blue, or green.

7. The cable pursuant to claim 5 where said nonmarker pair second conductors are natural insulation, natural insulation with strips of orange stain, or natural insulation with strips of black stain.

8. The cable pursuant to claim 2 where in each said subunit, a conductor pair having a particular color combination is arranged adjacent only to conductor pairs having different color combinations.

9. The cable pursuant to claim 8 where in said cable core, each said unit is wrapped with a first binder for identifying the position of said unit in said cable layer and a second binder for identifying said layer in which said unit is located.

10. The cable pursuant to claim 9 where each said cable layer comprises one marker unit which is wrapped with a first binder having a unique color for said binders in said layer.

11. The cable pursuant to claim 10 where within each said cable layer, said marker unit is flanked on either side with a unit wrapped with two binders having colors identical to the binders of said other flanking unit.

12. The cable pursuant to claim 11 where said marker unit in each said cable layer is adjacent to said marker units in adjacent cable layers and where said binders used to wrap each said non-marker unit are of predetermined colors to form a cable core having an identifiable unit arrangement which is symmetrical about said marker units.

* * * * *